US006640075B1

(12) United States Patent
Weber et al.

(10) Patent No.: US 6,640,075 B1
(45) Date of Patent: Oct. 28, 2003

(54) ELECTROPHOTOGRAPHIC DEVELOPMENT SYSTEM WITH TONER PURGING

(75) Inventors: Scott D. Weber, Canandalgua, NY (US); Robert W. Phelps, Victor, NY (US); Kristine A. German, Webster, NY (US); Dale R. Mashtare, Bloomfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/284,541

(22) Filed: Oct. 30, 2002

(51) Int. Cl.[7] ..... G03G 15/08; G03G 15/09
(52) U.S. Cl. ..... 399/257
(58) Field of Search ..... 399/257, 223, 399/228, 230, 272, 273

(56) References Cited

U.S. PATENT DOCUMENTS

| | | | | |
|---|---|---|---|---|
| 4,891,671 A | * | 1/1990 | Iwamasa | 399/257 |
| 5,025,289 A | * | 6/1991 | Guslits et al. | 399/257 |
| 5,140,373 A | * | 8/1992 | Ikegawa et al. | 399/272 |
| 5,557,393 A | | 9/1996 | Goodman et al. | 399/323 |
| 5,781,828 A | | 7/1998 | Caruthers et al. | 399/57 |
| 5,892,891 A | | 4/1999 | Dalal et al. | 358/1.9 |
| 5,897,239 A | | 4/1999 | Caruthers et al. | 399/54 |
| 5,899,605 A | | 5/1999 | Caruthers et al. | 399/223 |
| 5,933,683 A | | 8/1999 | Snelling et al. | 399/53 |
| 6,002,893 A | | 12/1999 | Caruthers et al. | 399/54 |
| 6,052,195 A | | 4/2000 | Mestha et al. | 356/425 |
| 6,307,645 B1 | | 10/2001 | Mantell et al. | 358/1.9 |

FOREIGN PATENT DOCUMENTS

JP 2000075666 A * 3/2000 ..... G03G/15/08

* cited by examiner

*Primary Examiner*—Joan Pendegrass
(74) *Attorney, Agent, or Firm*—Lloyd F. Bean, II

(57) ABSTRACT

An apparatus for developing a latent image recorded on an imaging surface with toner, including: a developer housing including a reservoir for storing a supply of toner; a donor member for transporting toner on an outer surface of the donor member to a development zone; a purging system, adjacent to the donor member, for removing toner the donor member and the reservoir.

15 Claims, 3 Drawing Sheets

ELECTROPHOTOGRAPHIC DEVELOPMENT SYSTEM WITH TONER PURGING

BACKGROUND OF THE INVENTION

This invention relates generally to a development apparatus for ionographic or electrophotographic imaging and printing apparatuses and machines, and more particularly is directed to a developer apparatus for providing custom colored marking particles.

Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of customer selectable color output can be found in the field of "custom color", which specifically refers to registered proprietary colors, such as used, for example, in corporate logos, authorized letterhead, and official seals. The yellow associated with Kodak brand products, and the brown associated with Hershey brand products are good examples of custom colors which are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields nonuniformity of the color in the image area.

Further, lines and text produced by halftone process color are very sensitive to misregistration of the multiple color images such that blurring, color variances, and other image quality defects may result. As a result of the deficiencies noted above, customer selectable color production in electrostatographic printing systems is typically carried out by providing a singular premixed developing material composition made up of a mixture of multiple color toner particles blended in preselected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof.

This concept has generally been extended to electrostatographic printing technology, as disclosed, for example, in commonly assigned U.S. Pat. No. 5,557,393, wherein an electrostatic latent image is developed by a dry powder developing material comprising two or more compatible toner compositions which have been mixed together to produce a customer selectable color output. Customer selectable color printing materials including paints, printing inks, and developing materials can be manufactured by determining precise amounts of constituent basic color components making up a given customer selectable color material, providing precisely measured amounts of each constituent basic color component, and thoroughly mixing these color components.

This process is commonly facilitated by reference to a color guide or swatch book containing hundreds or even thousands of swatches illustrating different colors, wherein each color swatch is associated with a specific formulation of colorants. Probably the most popular of these color guides is published by PANTONE®, Inc. of Moonachie, N.J. The PANTONE® Color Formula Guide expresses colors using a certified matching system and provides the precise formulation necessary to produce a specific customer selectable color by physically intermixing predetermined concentrations of up to four colors from a set of up to 18 principal or basic colors. There are many colors available using the PANTONE® system or other color formula guides of this nature that cannot be produced via typical halftone process color methods or even from mixing selected amounts of cyan, magenta, yellow and/or black inks or developer materials.

In the typical operational environment, an electrostatographic printing system may be used to print various customer selectable color documents. To that end, replaceable containers of premixed customer selectable color developing materials corresponding to each customer selectable color are provided for each print job.

Replacement of the premixed customer selectable color developer materials or substitution of another premixed color between different print jobs necessitates operator intervention which typically requires manual labor and machine downtime, among other undesirable requirements. In addition, since each customer selectable color is typically manufactured at an off-site location, supplies of each customer selectable color printing ink must be separately stored for each customer selectable color print job.

SUMMARY OF THE INVENTION

There is provided an apparatus for developing a latent image recorded on an imaging surface with toner, comprising: a developer housing including a reservoir for storing a supply of toner; a donor member for transporting toner on an outer surface of said donor member to a development zone; a purging system, adjacent to said donor member, for removing toner said donor member and said reservoir.

DETAILED DESCRIPTION OF THE FIGURES

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
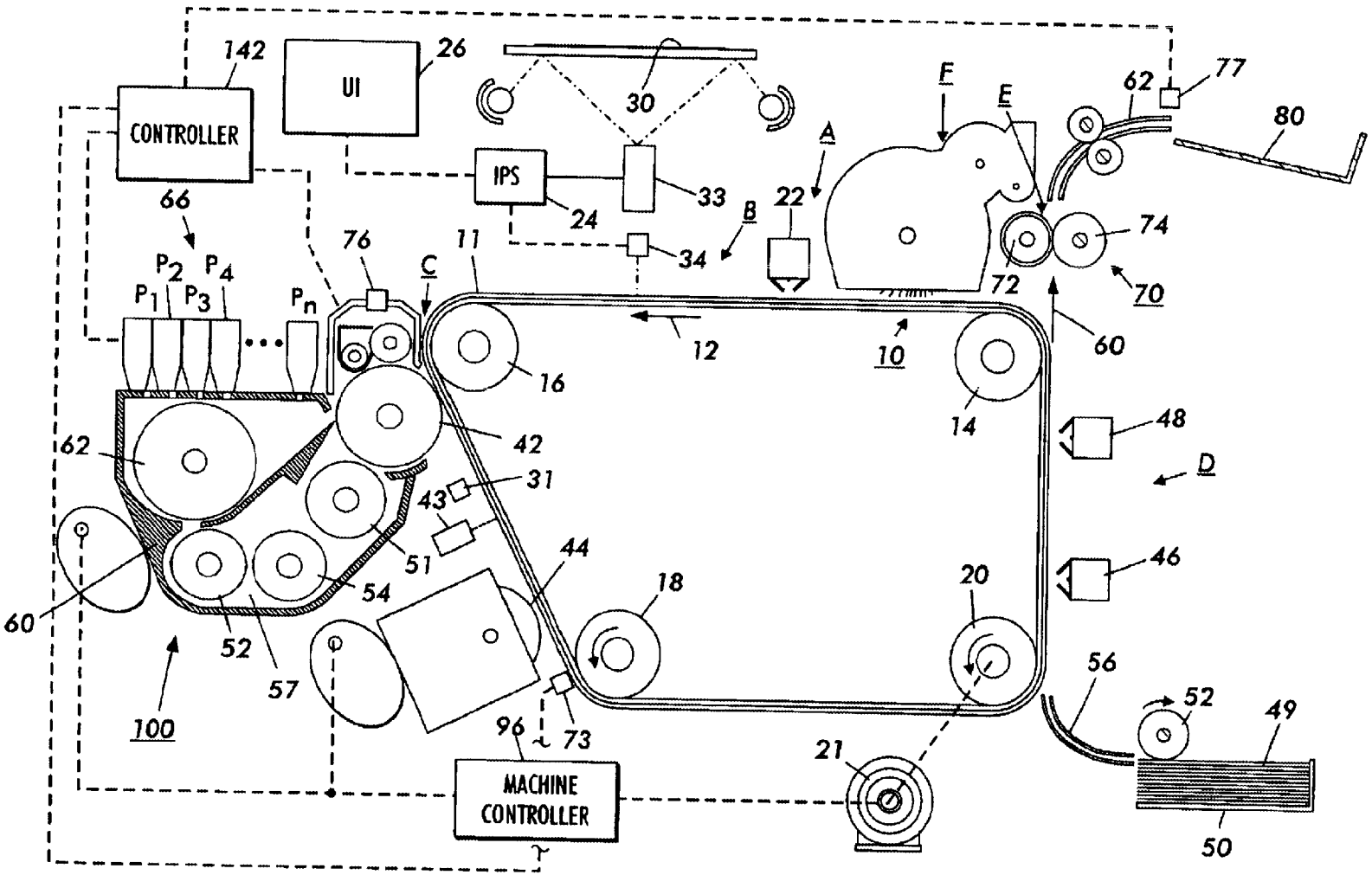
FIG. 1 is a schematic elevational view of an illustrative electrophotographic printing machine incorporating the present invention therein.

Turning now to FIG. 1, the electrophotographic printing machine uses a charge retentive surface in the form of a photoreceptor belt 10. The photoreceptor belt is supported by rollers 14, 16, 18, and 20. Motor 21 operates the movement of roller 20, which in turn causes the movement of the photoreceptor in the direction indicated by arrow 12, for advancing the photoreceptor sequentially through the various xerographic stations.

With continued reference to FIG. 1, a portion of photoreceptor belt 10 passes through charging station A where a corona generating device, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of the photoconductive surface is advanced through an imaging and exposure station B. A document 30, with a highlight color image and/or text original, is positioned on a raster input scanner (RIS), indicated generally by the reference numeral 33. One common type of RIS contains document illumination lamps, optics, a mechanical scanning drive, and a charged coupled device. The RIS captures the entire image from original document 30 and converts it to a series of raster scan lines. Alternatively, image signals may be supplied by a computer network. This information is transmitted as electrical signals to an image processing system (IPS), indicated generally by the reference numeral 24. IPS 24 converts image information into two colorant signals (i.e. black and the custom color). Alternatively, highlight color image and/or text original can be externally computer generated and sent to IPS to be printed.

The IPS contains control electronics which prepare and manage the image data flow to a raster output scanning device (ROS), indicated by numeral 34. A user interface (UI) indicated by 26 is in communication with IPS 24. UI 26 enables an operator to control the various operator adjustable functions such as selecting portion document to be printed with a custom color.

The operator actuates the appropriate keys of UI 26 to adjust the parameters of the copy. UI 26 may be a touch screen or any other suitable control panel providing an operator interface with the system. The output signal from UI 26 is transmitted to the IPS 24. The IPS then transmits signals corresponding to the desired image to ROS 34, which creates the output copy image. ROS 34 includes a laser with rotating polygon mirror blocks. The ROS illuminates, via mirror, the charged portion of a photoconductive belt 11. The ROS will expose the photoconductive belt to record single to multiple images which correspond to the signals transmitted from IPS 24.

The photoreceptor, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a monopolar voltage profile of high and low voltages, the former corresponding to charged areas and the latter corresponding to discharged or image areas.

A first development station C, indicated generally by the reference numeral 100, advances development material into contact with the electrostatic latent image. The development housing contains custom color toner and carrier. Appropriate developer biasing is accomplished via power supply. Electrical biasing is such as to effect discharged area development (DAD) of the lower (less negative) of the two voltage levels on the photoreceptor with the development material. This development system may be either an interactive or non-interactive system.

The photoconductive belt is recharged by corona device 31. A second exposure or imaging device 43 which may comprise a laser based output structure is utilized for selectively discharging the photoreceptor on toned areas and/or bare areas to approximately −50 volts, pursuant to the image to be developed with the second color developer. After this point, the photoreceptor contains toned and untoned areas at relatively high voltage levels (e.g. −500 volts) and toned and untoned areas at relatively low voltage levels (e.g. −50 volts). These low voltage areas represent image areas which are to be developed using discharged area development. To this end, a negatively charged developer material comprising, for example, a black toner is employed. The toner is contained in a developer housing structure 44 disposed at a second developer station and is presented to the latent images on the photoreceptor.

The photoreceptor belt 10 then advances the developed latent image to transfer station D. At transfer station D, a sheet of support material such as paper copy sheets, is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the photoreceptor belt 10, whereupon the sheet is stripped from the photoreceptor belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, are removed at cleaning station F.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to an user interface (not shown) where required.

It is believed that the foregoing description is sufficient for purposes of the present application to illustrate the general operation of an electrophotographic printing machine incorporating the development apparatus of the present invention therein.

Figure 2:
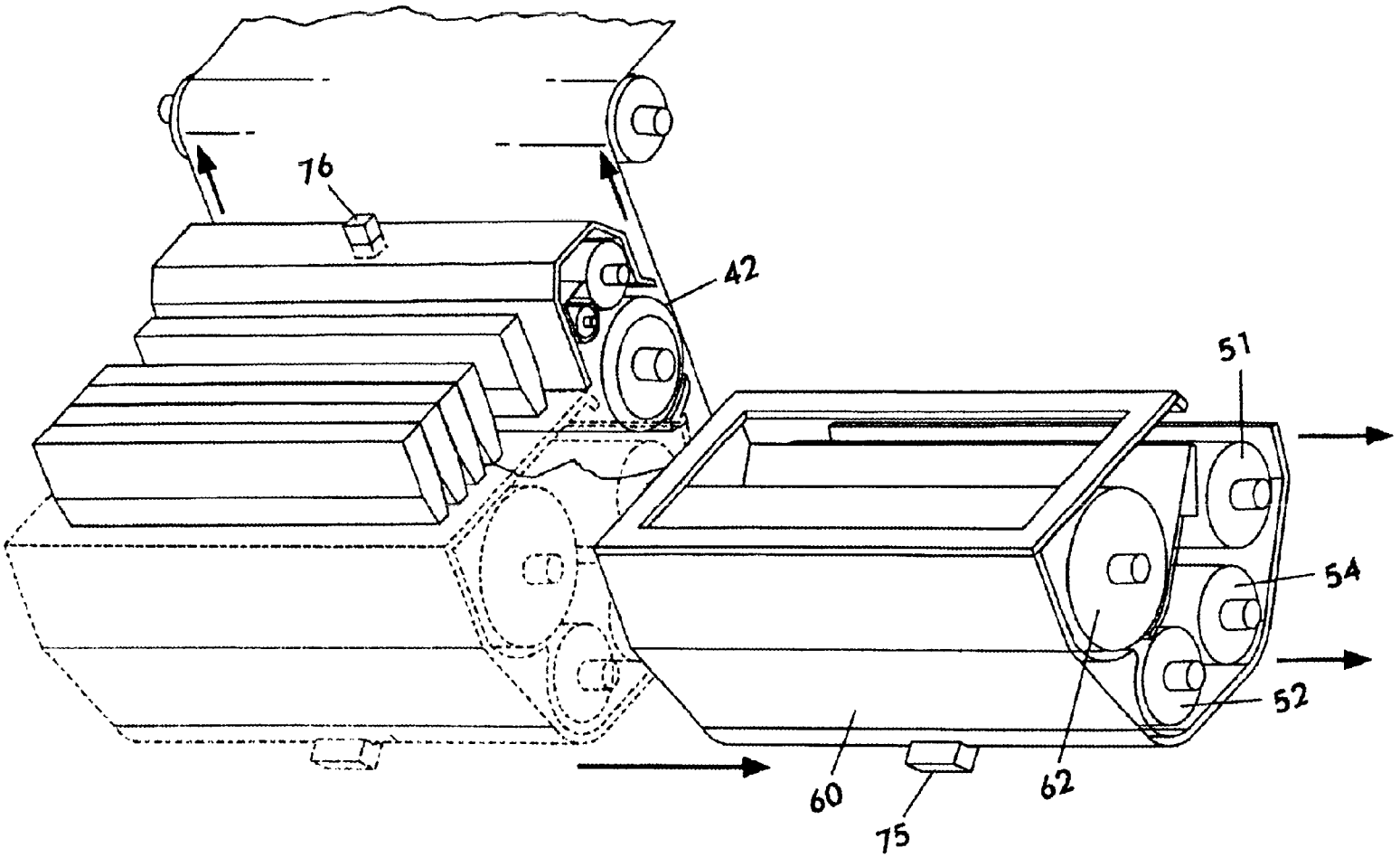
FIGS. 2 and 3 are a schematic illustration of the development system according to the present invention.
Figure 3:
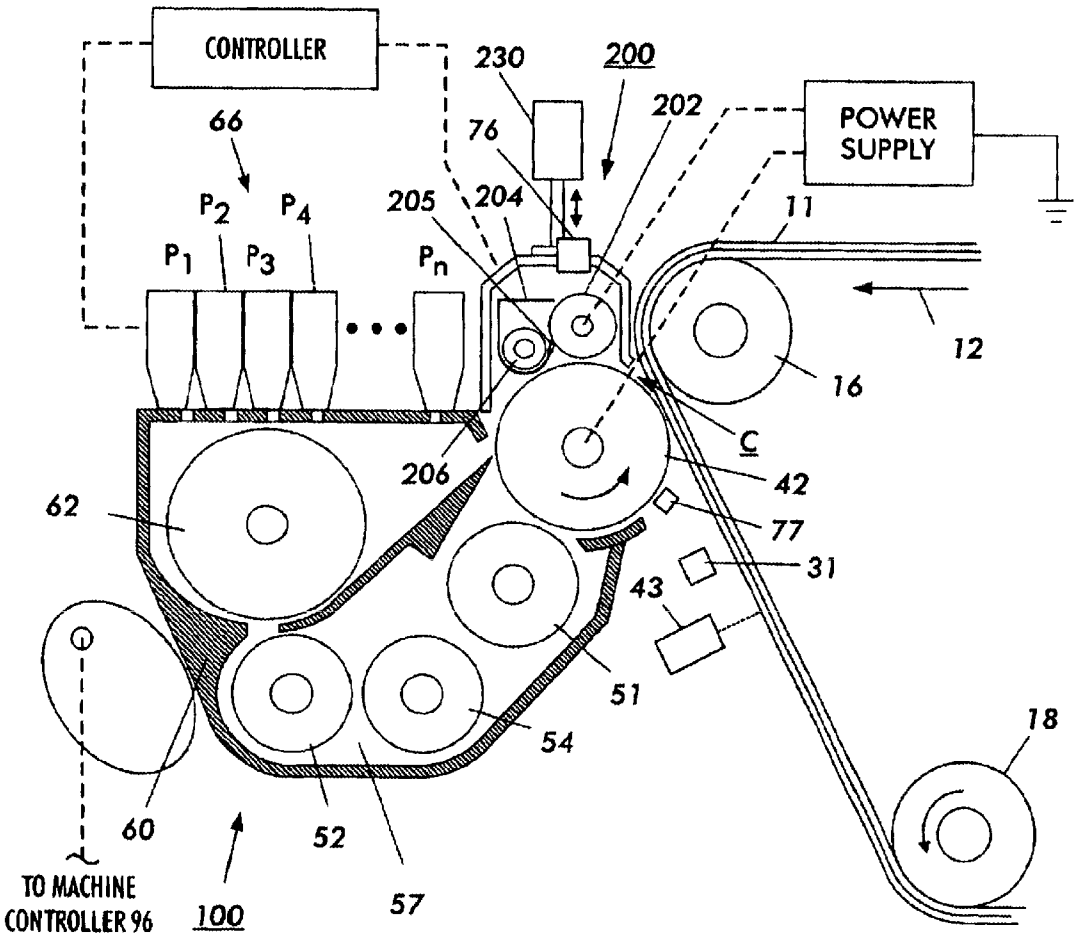

Focusing on the development station C before describing the color mixing and control system of the present invention, in the exemplary developing apparatus of FIG. 2. Preferably developing apparatus employs MAZE (magnetically agitated zone) such as disclosed in U.S. Pat. No. 5,933,683 which is hereby incorporated by reference. Donor member 42 comprises an interior rotatable harmonic multiple magnetic assembly within a sleeve. The sleeve can be rotated in either the "with" or "against" direction relative to the direction of motion of the photoreceptor belt 10. Similarly, the magnetic core can be rotated in either the "with" or "against" direction relative to the direction of motion of the sleeve developing material is transported from an supply sump 57 to the donor member 42 via a transport roll 51.

Supply sump 57 acts as a holding receptacle for providing an operative solution of developing material comprised of toner material and carrier, which, in the case of the customer selectable color application of the present invention, includes a blend of different colored marking particles on a common carrier. Preferably color marking particles are Emulsion Aggregation or Chemical Toners (EA) toners, but could be toner particles made from any variety of methods.

A plurality of replaceable supply dispensers $p_1$ through $p_n$, each containing a concentrated supply of marking particles corresponding to a basic color component in a color matching system, are provided in association with the operational supply sump 57. Housing 60 includes blender 62 blends the basic color component together which is then released into sump 57. Augers 52 and 54 transport developer material to transport roll 51. Housing 60 is removable from development station 100.

In operation, the application of marking particles to the latent image, clearly depletes the overall amount of the operative solution of developing material in supply sump 57. Therefore, sump 57 is continuously replenished, as necessary, by the addition of developing material or selective components thereof from dispensers 66. Since the total amount of any one component making up the developing material utilized to develop the image may vary as a function of the area of the developed image areas and the background portions of the latent image on the photoconductive surface, the specific amount of each component of the developing material which must be added to the supply sump 57 varies with each development cycle.

For example, a print job having a developed image having a large proportion of printed image area will cause a greater depletion of marking particles from a developing material sump as compared to a print job having a developed image with a small amount of printed image area.

The replenishment system includes a plurality of differently colored developing material supply dispensers p1 through pn, each coupled to the operative supply sump. Preferably, each supply dispenser contains a developing material of a known basic or primary color such as Cyan, Magenta, Yellow and Black. In one specific embodiment, the replenishment system includes nine supply dispensers, wherein each supply container provides a different basic color developing material as described in U.S. Pat. No. 5,892,891. Mixtures of the nine basic or constituent colors emulate the color mixtures of the PANTONE® Color Matching System, which employs a set of eleven basic ink colors.

Color formulations, similar to those provided by the PANTONE® System can be utilized, as for example, by storage in a look up table, to produce thousands of desirable output colors and shades in a customer selectable color printing. Using this system, as few as two different color developing materials, from supply containers P2 and P3 for example, can be combined in sump 57 to expand the color gamut of customer selectable colors far beyond the colors available via half tone imaging techniques. An essential component of the developing material color mixing and control system is a color control system.

An advantageous feature of the present invention is the toner purging station 200. This toner purging station 200 allows for a quicker color change over for new print jobs requiring a new custom color substantially different from the prior job without removing the development housing. Further, the carrier is left in the development housing and is reused with the next custom mixed color toner. The toner for this invention is preferably triboelectrically compatible across each of the 9 color pigments that have been identified as needed to emulate the Pantone color set. This invention allows for the reuse of carrier, is attractive from a Total Cost of Ownership, and environmental waste reduction standpoint.

Toner purging station 200 is within development housing. However toner purging can be remote from the printing. Toner purging station 200 includes a receiver roll 202 and a cleaning device 204 to clean receiver roll 202. Receiver roll 202 includes a conductive roll such as anodize aluminum. A cam assembly moves receiver roll 202 in to operative position adjacent to donor member 42. The operative position can be in contact with receiver roll 202 or be closely spaced therefrom, so that the toner bed height of the donor roll is about 0.010 to 0.020 inches from the receiver roll. A power supply (not shown) is electrically connected to receiver roll 202 and applies an electrical bias. The electrical bias is setup on the housing such that the development field is very strong, to allow for the rapid purging of the toner from the carrier. The receiver roll functions as a toner collector that is then cleaned by cleaning device 204. Cleaning device 204 includes cleaning means such as a blade 205 or brush to clean toner from surface of receiver roll 202. Cleaning device also includes a toner transport auger 206 for transporting the removed toner to a waste or reclaim container (not shown).

In operation of toner purging, receiver roll 202 is cammed into operative position adjacent to donor member 42. Development system parameter are changed from a printing mode to a purging mode. In the purging mode, development parameter is changed to obtained the maximum toner output from supply sump 57 employing donor member 42, and a transport roll 51. This can be achieved by increasing speed of donor member 42 and a transport roll 51 and adjusting the bias applied to donor member 42 and a transport roll 51. The purging station is run until the development housing is sufficiently stripped of toner. Depending on the change in hue, saturation and lightness between the purged color and the replacement color, the purged carrier must be stripped to a predefined TC, (for e.g. <0.5% TC) to avoid visible cross contamination of colors. At this point, the carrier is ready to be retoned by the introduction of the new custom color that needs to be printed. The toner mixture comprising the new custom color toner can be dispensed into the housing as a single pre-measured color mixture. Alternatively, the new custom color toner mixture can be measured and blended in situ by dispensing the appropriate ratio of each of the required basic toner colors either in parallel or sequentially.

The principles of the present invention have been tested, wherein a development housing was run in the configuration shown in FIG. 2 with a 800 gram cyan EA developer package with no additives. Initially the material had a tribo around 30 $\mu$C/g and a TC of 8.7%. After 5.5 minutes of stripping by a receiver roll, the resulting material properties revealed a tribo of around 130 $\mu$C/g and TC of 0.47%. The housing was then run for an additional 2 minutes, but there was no further change in the material properties. This indicates that in a very short amount of time a complete 800 gram developer package can be stripped of its toner.

One embodiment of this invention is to use the photoreceptor itself as the toner receiver for purging toner; the internal cleaning system could remove the stripped toner. This would stress the capacity of the cleaning system, but it could be overcome. One possible solution is the addition of a secondary cleaning system for detoning operations that could allow for the recycling and reuse of the toner. An alternate embodiment is to use a stand alone toner purging station with or without an integrated toner dispensing system for re-toning the stripped carrier. The station is available for servicing color changeovers for several development housings for a single printing machine or a fleet of machines.

Another advantagous feature of the present invention is that it can be employed with a customer selectable color mixing controller 142. Customer selectable color mixing controller is provided in order to determine appropriate amounts of each color developing material in supply containers P1 through Pn to be added to supply sump 57 to achieve the custom color, and to controllably supply each of such appropriate amounts of developing material.

Controller 142 may take the form of any known microprocessor based memory and processing device, as are well known in the art. The approach provided by the color mixing control system includes a sensing device 76 and 77, an optical sensor for monitoring the output color of the developer layer on donor member 42 and receiver roll 202, sensors 73 and 77 monitoring the output color on the donor member, photoconductive surface, and fused paper sheet, respectively. A toner concentration sensor 75 used in conjunction with a pixel counter. These sensors are connected to controller 142 for providing sensed color information thereto, which, in turn is used for controlling the flow of the variously colored replenishing developing materials from dispensers. The colored developing materials in dispensers correspond to the basic constituent colors of a color matching system, and are selectively delivered into the developing material supply sump 57 from each of the supply containers to produce the customer selectable color output image.

In operation, the UI 26 can indicate to the operator "please wait adjusting color" when a new custom color is requested (say red color associated with Xerox' digital stylized "X"). Purging station is enagaged for a short period of time for controller 142 to take data from sensor 76 to read the color within the housing. Then controller 142 compares new color with previous color printed by the housing 60. If the new custom color is within the pre-set value color space value then the housing (say housing having reddish colorant) then the purge mode is not activated. Next, customer selectable color mixing controller 142 determines the appropriate amounts of each color developing material in supply containers P1 through Pn to be added to supply sump 57 to achieve the new required custom color from the reddish colorant.

If custom color is outside the preset value color space (say housing having bluish colorant) then the purge mode is activated. The purging station is run until the development housing is sufficiently stripped of toner. At this point, the carrier is ready to be retoned by the introduction of the new custom color. Next, customer selectable color mixing controller 142 determines the appropriate amounts of each color developing material in supply containers P1 through Pn to be added to supply sump 57 to achieve the new required custom color.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on an imaging surface with toner, comprising:

a developer housing including;

a reservoir for storing a supply of toner;

a donor member for transporting toner on an outer surface of said donor member to a development zone;

a purging system, adjacent to said donor member, for removing toner said donor member and said reservoir, said purging system includes a receiver roll for removing toner from said donor member; said purging system further includes a cleaning device for removing toner from said receiver roll.

2. The apparatus as recited in claim 1; wherein said receiver roll includes a conductive roll having a bias applied thereto.

3. The apparatus as recited in claim 1, wherein said receiver roll is spaced from about 0.010 to 0.020 inches from a developer bed height of said donor member.

4. The apparatus as recited in claim 1, further including a toner dispenser for dispensing at least two different colored toner into said reservoir.

5. The apparatus as recited in claim 1, further including means for adjusting said donor member bias relative to said receiver roll to enhance toner stripping of said donor member.

6. The apparatus as recited in claim 1, wherein said apparatus employs magnetically agitated zone development.

7. An apparatus for developing a latent image recorded on an imaging surface with toner, comprising:

a developer housing including;

a reservoir for storing a supply of toner;

a donor member for transporting toner on an outer surface of said donor member to a development zone;

a purging system, adjacent to said donor member, for removing toner said donor member and said reservoir; and a cam assembly for positioning said purging system in an operable mode closely adjacent to said donor member.

8. An apparatus for developing a latent image recorded on an imaging surface with toner, comprising:

a developer housing including;

a reservoir for storing a supply of toner;

a donor member for transporting toner on an outer surface of said donor member to a development zone;

a purging system, adjacent to said donor member, for removing toner said donor member and said reservoir;

a controller for deactivating said purging station when a predefined toner concentration is reached.

9. An apparatus for detoning a developer housing including a reservoir for storing a supply of toner; a donor member for transporting toner on an outer surface of said donor member to a development zone, comprising:

a purging system, adjacent to said donor member, for removing toner said donor member and said reservoir, said purging system includes a receiver roll for removing toner from said donor member, said purging system further includes a cleaning device for removing toner from said receiver roll.

10. The apparatus as recited in claim 9, wherein said receiver roll includes a conductive roll having a bias applied thereto.

11. The apparatus as recited in claim 9, wherein said receiver roll is spaced from about 0.010 to 0.020 inches from a developer bed height of said donor member.

12. The apparatus as recited in claim 9, further including a toner dispenser for dispensing at least two different colored toner into said reservoir.

13. The apparatus as recited in claim 9, further including a controller for deactivating said purging station when a predefine toner concentration is reached.

14. The apparatus as recited in claim 9, further including means for adjusting said donor member bias relative to said receiver roll to enhance toner stripping of said donor member.

15. The apparatus as recited in claim 9, wherein said apparatus employs magnetically agitated zone development.

* * * * *